US011631940B2

(12) United States Patent
Takahashi et al.

(10) Patent No.: US 11,631,940 B2
(45) Date of Patent: Apr. 18, 2023

(54) WAVEGUIDE SLOT ANTENNA

(71) Applicant: NGK SPARK PLUG CO., LTD., Nagoya (JP)

(72) Inventors: Hiroyuki Takahashi, Nagoya (JP); Satoshi Hirano, Nagoya (JP); Naoko Mori, Nagoya (JP); Ikuro Aoki, Hachioji (JP); Takuya Adachi, Hachioji (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 279 days.

(21) Appl. No.: 17/055,001

(22) PCT Filed: Nov. 1, 2019

(86) PCT No.: PCT/JP2019/043126
§ 371 (c)(1),
(2) Date: Nov. 12, 2020

(87) PCT Pub. No.: WO2020/110610
PCT Pub. Date: Jun. 4, 2020

(65) Prior Publication Data

US 2021/0265736 A1 Aug. 26, 2021

(30) Foreign Application Priority Data

Nov. 26, 2018 (JP) ..... JP2018-220670

(51) Int. Cl.
*H01Q 13/10* (2006.01)
*H01Q 13/22* (2006.01)
*H01Q 21/00* (2006.01)

(52) U.S. Cl.
CPC ..... *H01Q 13/10* (2013.01); *H01Q 13/22* (2013.01); *H01Q 21/0043* (2013.01)

(58) Field of Classification Search
CPC ..... H01Q 13/10; H01Q 21/005; H01Q 21/0043
See application file for complete search history.

(56) References Cited

U.S. PATENT DOCUMENTS 5,055,852 A * 10/1991 Dusseux ..... H01Q 9/0414 343/846
9,099,789 B1 * 8/2015 Modro ..... H01Q 1/48
(Continued)

FOREIGN PATENT DOCUMENTS

JP 2005-051330 A 2/2005
JP 2005-051331 A 2/2005
(Continued)

OTHER PUBLICATIONS

Han et al.; Low-Cost Wideband and High-Gain Slotted Cavity Antenna Using High-Order Modes for Millimeter-Wave Application; IEEE Transactions on Antennas and Propagation, vol. 63, No. 11, Nov. 2015 (Year: 2015).*
(Continued)

*Primary Examiner* — Ab Salam Alkassim, Jr.
(74) *Attorney, Agent, or Firm* — Stites & Harbison, PLLC; Jeffrey A. Haeberlin

(57) ABSTRACT

A waveguide slot antenna is configured by a waveguide, formed by a dielectric substrate, a first conductive layer formed at a lower surface of the dielectric substrate, a second conductive layer formed at an upper surface of the dielectric substrate and provided with one or a plurality of slots, and a pair of side wall parts electrically connecting the first and second conductive layers and extending in a first direction, being provided with a power feeding part. The one or a plurality of slots include a first slot having a predetermined slot length along the first direction. The waveguide slot antenna has a structure in which, on a plan view from a second direction, the power feeding part overlaps the first
(Continued)

slot, and the power feeding part does not deviate from a range of the slot length along the first direction.

7 Claims, 5 Drawing Sheets

(56) References Cited

U.S. PATENT DOCUMENTS

| | | | | |
|---|---|---|---|---|
| 9,105,966 | B1 * | 8/2015 | Dou | H01Q 13/106 |
| 10,971,806 | B2 * | 4/2021 | Rogers | H01Q 21/26 |
| 2010/0321265 | A1 * | 12/2010 | Yamaguchi | H01Q 21/0043 343/771 |
| 2016/0126636 | A1 * | 5/2016 | Uemichi | H01Q 21/0043 343/771 |
| 2016/0126637 | A1 * | 5/2016 | Uemichi | H01Q 21/0043 343/771 |
| 2018/0191073 | A1 * | 7/2018 | Celik | H01Q 9/0435 |
| 2019/0067805 | A1 * | 2/2019 | Rogers | H01Q 21/26 |
| 2019/0334247 | A1 * | 10/2019 | Tong | H01Q 5/342 |
| 2020/0083605 | A1 * | 3/2020 | Quarfoth | H01Q 13/206 |
| 2020/0220273 | A1 * | 7/2020 | Ahmadloo | H01Q 21/0043 |
| 2020/0274250 | A1 * | 8/2020 | Gu | H01Q 3/30 |
| 2020/0335873 | A1 * | 10/2020 | Achour | H01Q 13/22 |
| 2020/0358204 | A1 * | 11/2020 | Dotlic | H01Q 9/0464 |
| 2021/0218146 | A1 * | 7/2021 | Hashimoto | H01Q 13/20 |
| 2021/0349206 | A1 * | 11/2021 | Kim | H01Q 13/16 |
| 2021/0399428 | A1 * | 12/2021 | Suzuki | H01Q 13/10 |

FOREIGN PATENT DOCUMENTS

| | | | |
|---|---|---|---|
| KR | 20130017274 | A | 2/2013 |
| WO | 2015/162992 | A1 | 10/2015 |

OTHER PUBLICATIONS

Jadhav et al.; Design of X-Band Conical Horn Antenna Using Coaxial Feed and Improved Design Technique for Bandwidth Enhancement; 2017 International Conference on Computing, Communication, Control and Automation (ICCUBEA) (Year: 2017).*

Korean Intellectual Property Office, Notification of Reason for Refusal (Office Action) issued in corresponding Application No. 10-2020-7036515 dated Dec. 25, 2021.

European Patent Office, Extended European Search Report issued in corresponding Application No. EP 19 88 9685 dated Jun. 27, 2022.

Ulfah, M.M., et al. "Bandwith Enhancement of Substrate Integrated Waveguide Cavity-Backed Slot Antenna," The 3rd International Conference on Wireless and Telematics, Jul. 27-28, 2017, pp. 90-93.

China National Intellectual Property Administration, Office Action issued in corresponding Application No. 201980052061.3 dated Nov. 28, 2022. English translation is not available.

* cited by examiner

WAVEGUIDE SLOT ANTENNA

TECHNICAL FIELD

The present invention relates to a waveguide slot antenna provided with one or a plurality of slots in a waveguide that is configured by using a dielectric substrate.

BACKGROUND ART

In radio communication using high-frequency signals of microwave band or millimeter wave band, there is known a waveguide slot antenna in which a plurality of slots are formed in a waveguide and high-frequency signals fed from a power feeding part are propagated (or transmitted) to the waveguide and radiated (emitted) as electromagnetic waves from the plurality of slots. In recent years, in light of reduction in size and weight of the waveguide slot antenna and easy processing of the waveguide slot antenna, there has been proposed a waveguide slot antenna having a structure in which a waveguide is configured with upper and lower conductive layers and side surface via conductor groups being formed so as to surround a dielectric substrate and a plurality of slots are provided at a part of the conductive layers (for example, Patent Document 1). Further, in connection with the waveguide slot antenna having such structure, a structure in which a short-circuit wall part as a short-circuit surface that is orthogonal to a signal transmission direction of the waveguide is provided has been proposed (for example, Patent Document 2). Ina case of a configuration of the waveguide slot antenna provided with the short-circuit wall part disclosed in Patent Document 2, generally, the power feeding part and the slots are arranged so as not to overlap each other when viewed from a height direction of a layered substrate (or a stacked substrate), and also the power feeding part and the short-circuit wall part are arranged so that a distance from a position of the short-circuit wall part located on a distant side from the slot to a position of the power feeding part is quarter times (¼ times) of a guide wavelength.

CITATION LIST

Patent Document

Patent Document 1: Japanese Patent Application No. 2005-051331

Patent Document 2: Japanese Patent Application No. 2005-051330

SUMMARY OF THE INVENTION

Technical Problem

In order to achieve the reduction in size of the waveguide slot antenna, it is required to shorten a length along the signal transmission direction as much as possible. However, in the above conventional structure, it is difficult to bring the power feeding part closer to the short-circuit wall part due to a periodicity of a standing wave in the waveguide. Further, approach of the power feeding part to the slot causes a problem in terms of characteristics due to mutual interference.

Therefore, according to the structure of the above waveguide slot antenna, the short-circuit wall part, the power feeding part and the slot must be arranged apart from each other, and this inevitably makes the length of the waveguide slot antenna along the signal transmission direction longer. In addition, there is a concern that a capacitance generated between an upper end portion of the power feeding part and the conductive layer formed at the dielectric substrate affects the characteristics. Accordingly, as a problem of the structure of the conventional waveguide slot antenna, there is a limit on reducing the size of the waveguide slot antenna while maintaining the characteristics.

The present invention was made in view of the above problem. The present invention therefore provides a waveguide slot antenna which is configured based on a structure and an arrangement of the power feeding part and which is suitable for the size reduction while maintaining the characteristics.

Solution to Problem

To solve the problem, a waveguide slot antenna of the present invention comprises: a waveguide formed by a dielectric substrate (10), a first conductive layer (11) formed at a lower surface of the dielectric substrate, a second conductive layer (12) formed at an upper surface of the dielectric substrate and provided with one or a plurality of slots (14), and a pair of side wall parts (W1, W2) electrically connecting the first conductive layer and the second conductive layer and extending in a first direction (X) that is a signal transmission direction; and a power feeding part (15) formed so as to penetrate the dielectric substrate at lease from the upper surface to the lower surface of the dielectric substrate and feeding an input signal to the waveguide. The one or the plurality of slots includes a first slot (14*a*) having a predetermined slot length (L) along the first direction. And, when viewed as a plan view from a second direction (Z) that is perpendicular to the second conductive layer, the power feeding part is arranged at a position where the power feeding part overlaps the first slot, and the power feeding part does not deviate from a range of the slot length along the first direction.

According to the waveguide slot antenna of the present invention, the power feeding part penetrating the dielectric substrate, which forms the waveguide, from the upper surface to the lower surface of the dielectric substrate is formed, and this power feeding part is arranged at the position where the power feeding part overlaps the first slot and where the power feeding part does not deviate from the slot length of the first slot, when viewed as the plan view from the second direction. Therefore, as compared with the conventional structure in which the power feeding part and the slot are arranged apart from each other in the first direction, great reduction in size of the waveguide slot antenna mainly in the first direction can be achieved. In this case, since the first slot and the upper end portion of the power feeding part act as one antenna having an integral shape, an influence on the antenna characteristics due to the mutual interference can be suppressed. Further, since the structure of the present invention is not a structure in which the power feeding part faces the second conductive layer at a predetermined distance, a capacitance component between the power feeding part and the second conductive layer can be reduced, thereby improving high-frequency characteristics.

The power feeding part of the present invention can be formed by a power feeding terminal (15*a*) arranged on a same plane as the first conductive layer and not being in contact with the first conductive layer, an upper end portion (15*b*) arranged on a same plane as the second conductive layer and not being in contact with the second conductive layer and a power feeding via conductor (15*c*) whose lower end is connected to the power feeding terminal and whose upper end is connected to the upper end portion. With this structure, since the upper end portion of the power feeding part is arranged on the same plane as the second conductive layer, especially a capacitance component between the upper end portion and the second conductive layer can be greatly reduced, and impedance matching can be properly adjusted according to a diameter of the power feeding via conductor.

Further, in the present invention, a short-circuit wall part (W3) electrically connecting the first conductive layer and the second conductive layer and being at least one of short-circuit surfaces of the waveguide which are orthogonal to the first direction could be formed, and a distance between the short-circuit wall part and the power feeding part along the first direction could be set to be ¼ times of a guide wavelength of the waveguide. With this configuration, a zero point of an electric field of a standing wave in the waveguide can be made to coincide with a position of the short-circuit wall part, and a peak of the electric field can be made to coincide with a position of the power feeding part. In this case, the pair of side wall parts and the short-circuit wall part can be formed by a plurality of via conductors connecting the first conductive layer and the second conductive layer. With this configuration, when employing a laminating technique (or a stacking technique) of manufacturing the dielectric substrate, it is possible to easily form the side wall part and the short-circuit wall part of the waveguide into respective desired shapes.

In the present invention, when viewed as the plan view from the second direction, the one or the plurality of slots could be arranged at a position where the one or the plurality of slots is shifted from a center position between the pair of side wall parts in a third direction (Y) that is orthogonal to the first and second directions. With this arrangement, each slot can be arranged at an optimal position mainly according to distribution of a magnetic field in the waveguide. In this case, the one or the plurality of slots could include only the first slot. Alternatively, the one or the plurality of slots could include a slot except the first slot, and adjacent slots of the one or the plurality of slots could be arranged at symmetrical positions with respect to the center position in the third direction.

Effects of the Invention

According to the present invention, since the power feeding part penetrating the dielectric substrate from the upper surface to the lower surface of the dielectric substrate is arranged so as to overlap the first slot when viewed as the plan view, the size reduction of the waveguide slot antenna can be achieved. Further, on condition that the power feeding part does not deviate from the range of the slot length of the first slot in the first direction, the power feeding part and the first slot act as the integral antenna without mutual interference, and also the capacitance component between the power feeding part and the second conductive layer can be reduced, thereby securing good characteristics of the waveguide slot antenna.

BRIEF DESCRIPTION OF THE DRAWINGS

FIG. 1A is a top view of the waveguide slot antenna, when viewed from above. FIG. 1B is a sectional view of the waveguide slot antenna, taken along a plane A-A of FIG. 1A. FIG. 1C is a bottom view of the waveguide slot antenna of FIG. 1A, when viewed from below.

FIG. 2A is a top view corresponding to FIG. 1A. FIG. 2B is a sectional view corresponding to FIG. 1B. FIG. 2C is a bottom view corresponding to FIG. 1C.

EMBODIMENTS FOR CARRYING OUT THE INVENTION

Preferred embodiments of the present invention will be explained below with reference to the drawings. However, the embodiments described below are examples to which technical concepts of the present invention are applied, and the present invention is not limited by contents of the embodiments.

Figure 1A:
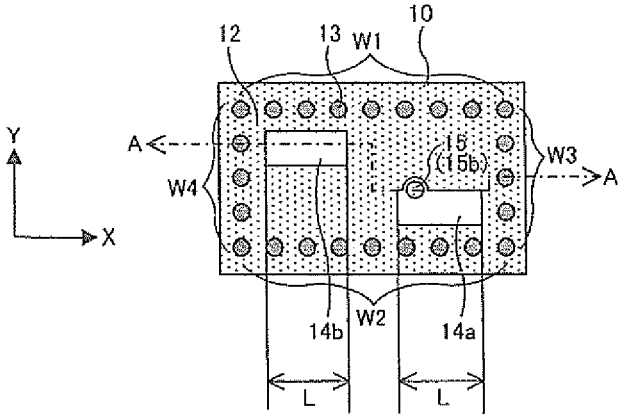
FIGS. 1A to 1C are drawings showing an example of a structure of a waveguide slot antenna according to an embodiment to which the present invention is applied.
Figure 1B:
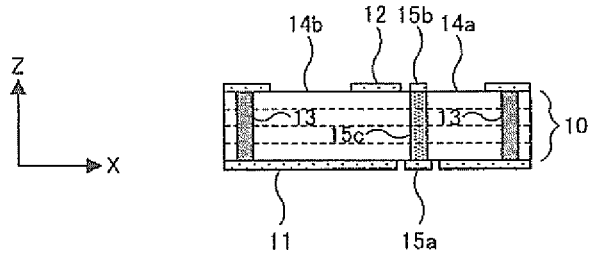
Figure 1C:
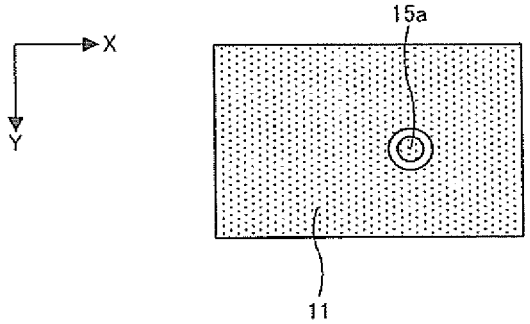

First, a structure of a waveguide slot antenna according to an embodiment to which the present invention is applied will be explained using FIGS. 1A to 1C. FIG. 1A is a top view of the waveguide slot antenna of the present embodiment, when viewed from above. FIG. 1B is a sectional view of the waveguide slot antenna, taken along a plane A-A of FIG. 1A. FIG. 1C is a bottom view of the waveguide slot antenna of FIG. 1A, when viewed from below. For convenience in explanation, in FIGS. 1A to 1C, an X-direction (a first direction of the present invention), a Y-direction (a third direction of the present invention) and a Z-direction (a second direction of the present invention) which are orthogonal to each other are indicated by arrows.

The waveguide slot antenna of the present embodiment has a dielectric substrate 10 made of dielectric material such as ceramic, a conductive layer 11 (a first conductive layer of the present invention) made of conductive material and formed at a lower surface of the dielectric substrate 10, a conductive layer 12 (a second conductive layer of the present invention) made of conductive material and formed at an upper surface of the dielectric substrate 10, a plurality of via conductors 13 connecting the upper and lower conductive layers 12 and 11, a plurality of slots 14 (14*a* and 14*b*) formed at the upper-surface conductive layer 12 and a power feeding part 15 formed so as to penetrate the upper and lower surfaces of the dielectric substrate 10 (so as to penetrate the dielectric substrate 10 from the upper surface to the lower surface of the dielectric substrate 10). Here, FIG. 1A illustrates a state in which the plurality of via conductors 13 are seen through from the conductive layer 12 side.

The dielectric substrate 10 has a rectangular parallelepiped in outside shape whose longitudinal direction is the X-direction, and is generally formed by a plurality of stacked dielectric layers. Upper and lower sides (both sides in the Z-direction) of a periphery of the dielectric substrate 10 are covered with the pair of conductive layers 12 and 11, and the plurality of via conductors 13 are arranged along four side surfaces (both sides in the X-direction and both sides in the Y-direction) of the periphery of the dielectric substrate 10. With this configuration, the dielectric substrate 10 functions as a waveguide surrounded by metal members formed of the pair of conductive layers 11 and 12 and the plurality of via conductors 13. In this waveguide, for instance, a TE10 mode is propagated (or transmitted) as a main mode with upper and lower surfaces being H-planes and with the X-direction being a signal transmission direction.

The plurality of via conductors 13 are a plurality of columnar conductors formed by filling a plurality of via holes penetrating the dielectric substrate 10 with conductive material. These via conductors 13 are arranged such that a distance or an interval between adjacent via conductors 13 is equal to or less than a half of a cutoff wavelength of the waveguide. A lower end of each of the plurality of via conductors 13 is connected to the conductive layer 11, an upper end of each of the plurality of via conductors 13 is connected to the conductive layer 12, and a side surface (a peripheral surface) of each columnar conductor is covered with the dielectric substrate 10 without being exposed to the outside. As shown in FIG. 1A, on a plan view viewed from the Z-direction, the plurality of via conductors 13 are divided into a pair of side wall parts W1 and W2 that extend in two rows (or two lines) in the X-direction and a pair of short-circuit wall parts W3 and W4 that extend in two lines (or two rows) in the Y-direction. That is, of the waveguide formed of the dielectric substrate 10, the pair of side wall parts W1 and W2 form both side surfaces on an X-Z plane, and the pair of short-circuit wall parts W3 and W4 form short-circuit surfaces on a Y-Z plane that is perpendicular to the X-direction of the signal transmission direction.

Here, with regard to the pair of side wall parts W1 and W2 and the pair of short-circuit wall parts W3 and W4, their configurations are not limited to the case where the side wall parts W1 and W2 and the short-circuit wall parts W3 and W4 are formed by using the plurality of via conductors 13 shown in FIG. 1A, but these pair of side wall parts W1 and W2 and pair of short-circuit wall parts W3 and W4 could be formed by using a solid conductive wall(s) surrounding four sides of the dielectric substrate 10 when viewed as the plan view from the Z-direction. Further, assuming that the waveguide slot antenna of the present embodiment is connected to other waveguides or other devices, the present invention can be applied even to a structure in which either one or both of the pair of short-circuit wall parts W3 and W4 is omitted.

The plurality of slots 14 are arranged along the X-direction at the conductive layer 12 at predetermined intervals. The present embodiment shows a case where the two slots 14*a* and 14*b* are provided in this order from a right side in FIG. 1A. On the plan view viewed from the Z-direction, each of the slots 14*a* and 14*b* has a rectangular shape having a predetermined slot length L in the X-direction and a predetermined width in the Y-direction. Here, the power feeding part 15 is provided at a position that overlaps the one slot 14*a* of the two slots. This configuration will be explained later. As can be understood from FIG. 1B, the conductive layer 12 opens at positions of the two slots 14, and the dielectric substrate 10 located under the conductive layer 12 is partly exposed. Further, as shown in FIG. 1A, the slots 14*a* and 14*b* are arranged at positions where the slots 14*a* and 14*b* are shifted from a center position in the Y-direction between the pair of side wall parts W1 and W2 to symmetrical positions with respect to the center position. In the present embodiment, the slot lengths L of the two slots 14, the interval between the two slots 14 and shifting amounts (shifting distances) of the two slots 14 in the Y-direction are properly set so as to improve antenna characteristics according to distribution of an electric field and a magnetic field in the waveguide.

As shown in FIG. 1B, the power feeding part 15 is formed by a power feeding terminal 15*a* arranged on (or within) the same plane as the lower-surface conductive layer 11, an upper end portion 15*b* arranged on (or within) the same plane as the upper-surface conductive layer 12 and a power feeding via conductor 15*c* electrically connecting these power feeding terminal 15*a* and upper end portion 15*b*. The power feeding terminal 15*a* and the upper end portion 15*b* are made of the same conductive material as those of the conductive layers 11 and 12, but the power feeding terminal 15*a* and the upper end portion 15*b* are not in contact with the conductive layers 11 and 12 respectively. Therefore, on the plan view viewed from the Z-direction, ring-shaped open patterns are formed around the power feeding terminal 15*a* and the upper end portion 15*b* respectively. In this manner, the power feeding part 15 has a structure in which the power feeding part 15 penetrates the lower surface and the upper surface of the dielectric substrate 10, and external input signals are successively provided to the via conductor 15*c* and the upper end portion 15*b* through the power feeding terminal 15*a* and transmitted in the waveguide. The power feeding via conductor 15*c* is formed into a cylindrical column, and its diameter is properly set so as to optimize impedance matching of the power feeding part 15.

As described above, on the plan view viewed from the Z-direction, the power feeding part 15 is arranged at the position where the power feeding part 15 partly overlaps the right-side slot 14*a*. That is, an area where the power feeding part 15 and the slot 14*a* overlap each other has such a shape that a part of a long side of a rectangular basic shape of the slot 14*a* protrudes in the shape of semicircle. Further, a distance between a center position of the power feeding part 15 and the right-side short-circuit wall part W3 along the X-direction is set to be quarter times (¼ times) of a guide wavelength of the waveguide. This is because a peak of the electric field of a standing wave generated in the X-direction in the waveguide is made to coincide with the position of the power feeding part 15 and a zero point of the electric field is made to coincide with the position of the short-circuit wall part W3. With such structure and arrangement of the power feeding part 15, it is possible to obtain an effect of reducing the size of the waveguide slot antenna of the present embodiment and an effect of reducing a capacitance component generated between the power feeding part 15 and the conductive layer 12. These effects will be explained in detail in the following description.

Figure 2A:
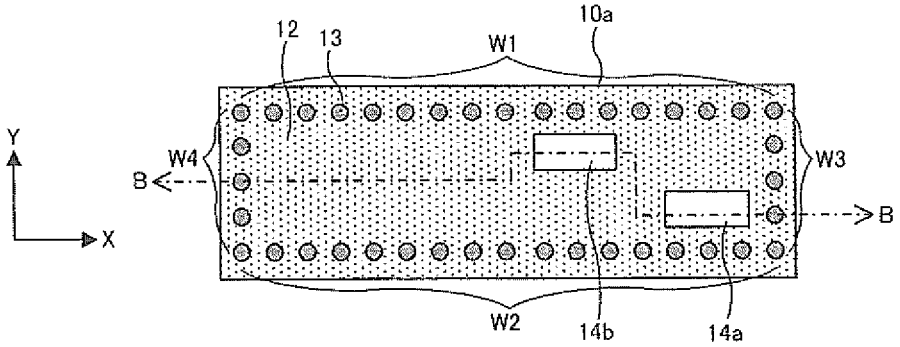
FIGS. 2A to 2C are drawings showing a comparative example, to explain effects of the present invention.
Figure 2B:
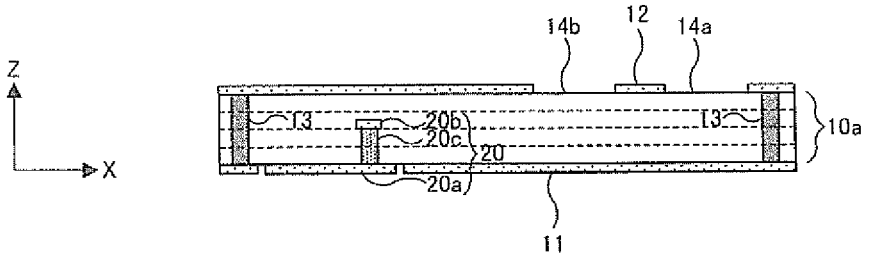
Figure 2C:
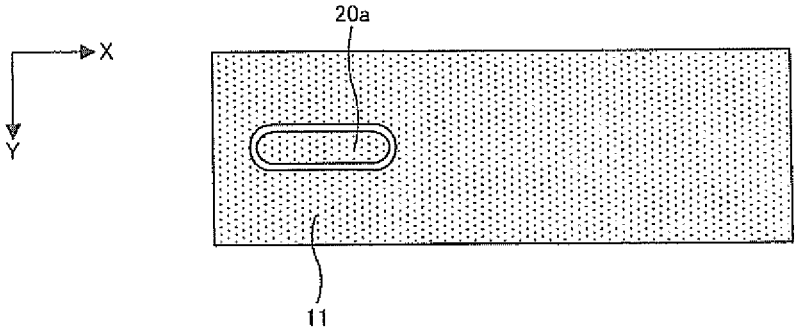

FIGS. 2A to 2C are drawings of a comparative example to explain the effects of the present invention. FIGS. 2A to 2C show a configuration of the waveguide slot antenna provided with a power feeding part 20 having conventional structure and arrangement. FIG. 2A is a top view corresponding to FIG. 1A. FIG. 2B is a sectional view (a sectional view taken along a plane B-B of FIG. 2A) corresponding to FIG. 1B. FIG. 2C is a bottom view corresponding to FIG. 1C. In the configuration of FIGS. 2A to 2C, the power feeding part 20 whose structure and arrangement are different from those of the power feeding part 15 (FIGS. 1A to 1C) is provided. Further, regarding a dielectric substrate 10*a* of FIGS. 2A to 2C, its size in the X-direction is longer than that of the dielectric substrate 10 of the present embodiment according to the arrangement of the power feeding part 20. The other structures are the same as those of FIGS. 1A to 1C. Their explanation is therefore omitted here.

In FIGS. 2A to 2C, on a plan view viewed from the Z-direction, the power feeding part 20 is arranged at a position that does not overlap two slots 14. This is an arrangement mainly for suppressing interference of electromagnetic wave between the two slots 14 (14*a* and 14*b*) and the power feeding part 20. On the other hand, a distance along the X-direction between a center position of the power feeding part 20 and a left-side short-circuit wall part W4 in the dielectric substrate 10*a* is set to be quarter times (¼ times) of a guide wavelength of the waveguide. This is because a peak of an electric field of a standing wave generated in the X-direction in the waveguide is made to coincide with the position of the power feeding part 20 and a zero point of the electric field is made to coincide with the position of the short-circuit wall part W4. Due to such arrangement of the power feeding part 20, the dielectric substrate 10*a* of FIGS. 2A to 2C requires a length in the X-direction equal to or more than twice the length of the dielectric substrate 10 of FIGS. 1A to 1C.

Further, the power feeding part 20 of FIGS. 2A to 2C is formed by a power feeding terminal 20*a* arranged on (or within) the same plane as a lower-surface conductive layer 11, an upper end portion 20*b* formed on an inner layer of the dielectric substrate 10*a* and a power feeding via conductor 20*c* electrically connecting these power feeding terminal 20*a* and upper end portion 20*b*. A distinct difference in structure between the power feeding part 20 of FIGS. 2A to 2C and the power feeding part 15 of FIGS. 1A to 1C is that the power feeding part 20 does not penetrate the dielectric substrate 10*a* from an upper surface to a lower surface of the dielectric substrate 10*a* and the upper end portion 20*b* is located at a position that is lower than that of the upper end portion 15*b* of FIG. 1B in the Z-direction. Then, by the difference of height of the upper end portion 20*b*, a height in the Z-direction of the power feeding via conductor 20*c* of FIG. 2B is shorter (lower) than that of the power feeding via conductor 15*c* of FIG. 1B. On the other hand, a length in the X-direction of the power feeding terminal 20*a* is longer than that of the power feeding terminal 15*a* of FIGS. 1B and 1C.

Figure 3:
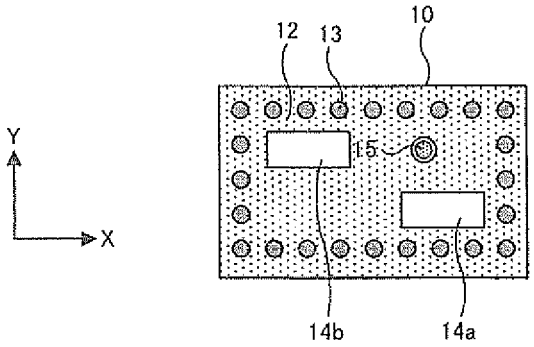
FIG. 3 is a drawing showing an example of a first arrangement of a power feeding part 15 which is an unfavorable arrangement in terms of antenna characteristics.

Although the structure and the arrangement of the power feeding part 15 of the present embodiment are effective in reducing the size of the dielectric substrate 10, as a precondition, it is required to take account of an influence of the overlapping arrangement of the power feeding part 15 and the one slot 14*a* on the antenna characteristics. FIG. 3 illustrates an example of a first arrangement of the power feeding part 15 which is an unfavorable arrangement in terms of the antenna characteristics. In the example of the first arrangement, while a position of the power feeding part 15 in the X-direction is maintained in the same manner as FIG. 1A, a position of the power feeding part 15 in the Y-direction is located apart from the slot 14*a* so as not to overlap the slot 14*a*. In the case of the first arrangement, the power feeding part 15 functions as a separate antenna located close to the slot 14*a*, and two pseudo antennas whose positions in the X-direction are the same interfere with each other, then this consequently poses a risk of deterioration in the antenna characteristics of the slot 14*a*. In contrast to this, according to the arrangement of the power feeding part 15 of the present embodiment, the power feeding part 15 (the upper end portion 15*b*) and the slot 14*a* act as an integral antenna having the arrangement in which the shape of the power feeding part 15 overlaps the rectangular basic shape of the slot 14*a*, then the aforementioned mutual interference can be suppressed.

Figure 4:
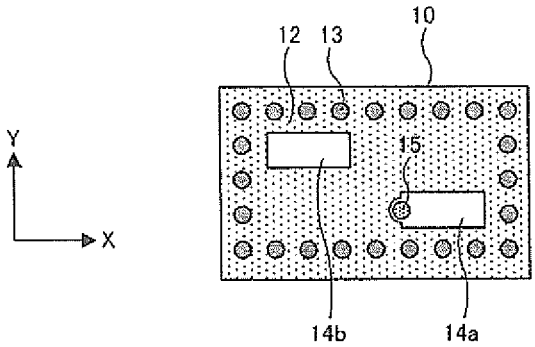
FIG. 4 is a drawing showing an example of a second arrangement of the power feeding part 15 which is an unfavorable arrangement in terms of the antenna characteristics.

Furthermore, FIG. 4 illustrates an example of a second arrangement of the power feeding part 15 which is an unfavorable arrangement in terms of the antenna characteristics. In the example of the second arrangement, a position of the power feeding part 15 deviates from a range of the slot length L of the slot 14*a* along the X-direction. Therefore, an integral slot having the arrangement in which the shape of the power feeding part 15 overlaps the rectangular basic shape of the slot 14*a* has a slot length that expands beyond the slot length L. Since a resonance frequency of the waveguide slot antenna is generally dependent on the slot length of the slot 14, it is inevitable that the arrangement of the power feeding part 15 of the second arrangement example will affect the resonance frequency of the waveguide slot antenna having the configuration of FIGS. 1A to 1C. In contrast to this, according to the arrangement of the power feeding part 15 of the present embodiment, since the position of the power feeding part 15 does not deviate from the range of the slot length L of the slot 14*a* along the X-direction, the above influence on the resonance frequency can be prevented. Here, the range of the slot length L of the slot 14*a* means an area sandwiched by (between) a pair of long sides that extend along the X-direction which define the rectangular slot 14*a*.

On the other hand, when focusing attention on the capacitance component of the power feeding part 15 of the present embodiment, since the upper end portion 15*b* is located on (or within) the same plane as the conductive layer 12, the capacitance component between the power feeding part 15 and the conductive layer 12 is small. In contrast to this, in the case of the power feeding part 20 having the conventional structure shown in FIGS. 2A to 2C, its upper end portion 20*b* located on the inner layer faces the upper and lower conductive layers 12 and 11 in the Z-direction at relatively close distances to the both conductive layers 12 and 11 along the Z-direction. In addition, the dielectric substrate 10*a* whose dielectric constant is high is interposed between the upper end portion 20*b* and the both conductive layers 12 and 11. Although each of the power feeding parts 15 and 20 has the capacitance components existing at the power feeding terminals 15*a* and 20*a* and the power feeding via conductors 15*c* and 20*c* respectively, since an influence of the difference of the position in the Z-direction of the upper end portion 20*b* is particularly significant, the capacitance component of the power feeding part 20 of FIGS. 2A to 2C becomes extremely large as compared with that of the power feeding part 15 of the present embodiment. Thus, in comparison with the power feeding part 20 of FIGS. 2A to 2C, the power feeding part 15 of the present embodiment can improve high-frequency characteristics by reducing the capacitance component.

As explained above, the waveguide slot antenna to which the present invention is applied can maintain good characteristics while realizing the effect of the size reduction by employing the structure and the arrangement of the power feeding part 15 which are different from the conventional structure and arrangement. As is obvious by a comparison between FIGS. 1A to 1C and FIGS. 2A to 2C, the size in the X-direction of the waveguide slot antenna of the present embodiment is mainly dependent on the number and the arrangement of the slots 14, and thus enlargement of the size in the X-direction due to the power feeding part 15 being provided does not occur. On the other hand, as for the size in the X-direction of the waveguide slot antenna having the conventional structure shown in FIGS. 2A to 2C, in addition to the number and the arrangement of the slots 14, by providing the power feeding part 20, an extra size along the X-direction is required. For instance, when comparing FIGS. 1A to 1C with FIGS. 2A to 2C, it can be seen that by employing the present invention, the size in the X-direction of the waveguide slot antenna is substantially half or less than half of that of the conventional structure.

Figure 5:
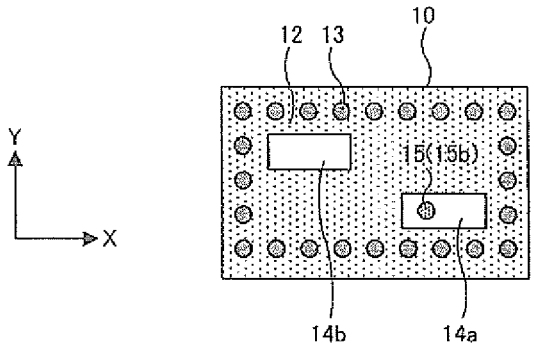
FIG. 5 is a drawing showing a first modification in which a position of the power feeding part 15 is changed.

The waveguide slot antenna to which the present invention is applied is not limited to the configuration of FIGS. 1A to 1C, but a variety of modifications are possible on condition that the modifications can obtain the effect of the present invention. FIG. 5 is a drawing of a first modification in which the position of the power feeding part 15 is changed, which is a top view corresponding to FIG. 1A. That is, on the plan view viewed from the Z-direction, the case of FIG. 1A illustrates the arrangement in which a part of the power feeding part 15 overlaps the slot 14*a*, whereas a case of the first modification illustrates an arrangement in which the whole power feeding part 15 overlaps the slot 14*a*. In other words, on the plan view viewed from the Z-direction, a circular region of the power feeding part 15 is enclosed with (or located within) a rectangular region of the slot 14*a*. It is noted that a structure in the Z-direction and a position in the X-direction of the power feeding part 15 of FIG. 5 are the same as those of FIGS. 1A to 1C. In the first modification, even though the power feeding part 15 is provided, the basic shape of the slot 14*a* itself is maintained. Further, with respect to the effects of the size reduction and the good characteristics of the waveguide slot antenna, even when employing the first modification, the same effects as those mentioned above can be obtained.

Figure 6:
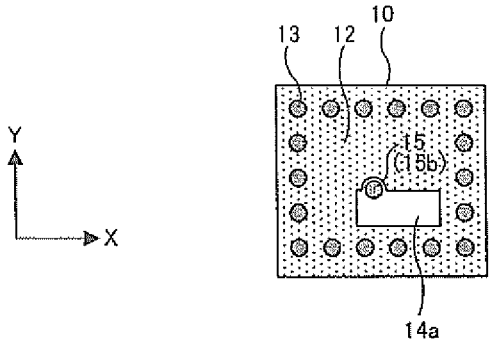
FIG. 6 is a drawing showing a second modification in which the number of slots 14 is changed.

Further, FIG. 6 is a drawing of a second modification in which the number of slots 14 is changed, which is a top view corresponding to FIG. 1A. As can be seen from FIG. 6, only one slot 14*a* is provided at the conductive layer 12. An arrangement of the power feeding part 15 that overlaps the slot 14*a* in FIG. 6 is the same as that of FIG. 1A. Ina case where the second modification is employed, although a radiation level of the waveguide slot antenna becomes small as compared with a case where the plurality of slots 14 are provided, the size in the X-direction of the waveguide slot antenna can be reduced to a minimum. Therefore, a configuration of the second modification is most suitable for the size reduction.

It is noted that as long as the slot 14 functions as the waveguide slot antenna, the number of the slots 14 is not limited to one or two. For instance, even when arranging three or more slots 14, i.e. the plurality of slots 14, by employing the present invention, the effect of the size reduction of the waveguide slot antenna can be obtained, as compared with a case where the same number of slots 14 is provided using the conventional structure. Further, the present embodiment explains a case where each slot 14 has the same slot length L. However, the plurality of slots 14 could have different slot lengths L.

Figure 7A:
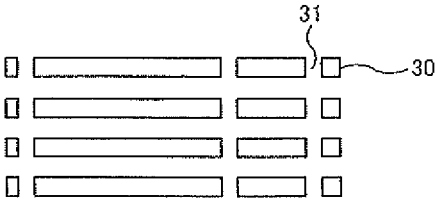
FIGS. 7A to 7C are drawings for schematically explaining a method of manufacturing the waveguide slot antenna according to the embodiment.

Next, a method of manufacturing the waveguide slot antenna of the present embodiment will be schematically explained with reference to FIGS. 7A to 7C. First, as the plurality of dielectric layers that will form the dielectric substrate 10, a plurality of ceramic green sheets 30 for low-temperature firing (or low-temperature baking) which are formed, for instance, by the doctor blade method are prepared. Then, as shown in FIG. 7A, punching is performed at predetermined positions of each of the ceramic green sheets 30, and a plurality of via holes 31 are opened. Positions and the number of via holes 31 on the ceramic green sheets 30 are set according to the arrangement of the plurality of via conductors 13 that are the pair of side surfaces and the pair of short-circuit surfaces of the waveguide and the arrangement of the power feeding via conductor 15*c*.

Figure 7B:
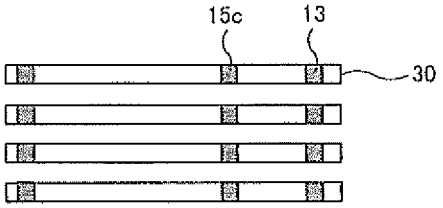
Figure 7C:
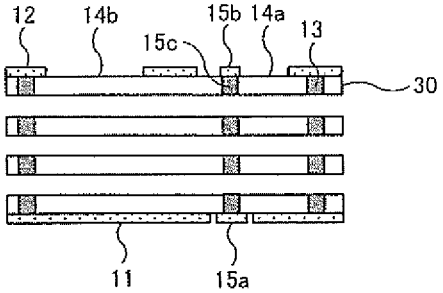

Next, as shown in FIG. 7B, by filling each of the plurality of via holes 31 opened on the ceramic green sheets 30 with conductive paste containing Cu by screen printing, the plurality of via conductors 13 and one power feeding via conductor 15*c* are formed. Subsequently, as shown in FIG. 7C, by applying conductive paste containing Cu to a lower surface of a lowermost ceramic green sheet 30 by screen printing, the conductive layer 11 and the power feeding terminal 15*a* of the power feeding part 15 are formed. Likewise, by applying conductive paste containing Cu to an upper surface of an uppermost ceramic green sheet 30 by screen printing, the conductive layer 12 having the slots 14*a* and 14*b* and the upper end portion 15*b*, which is enclosed with the ring-shaped open pattern, of the power feeding part 15 are formed.

Then, the plurality of ceramic green sheets 30 are stacked in layers in order, and by heating and pressurizing the stacked ceramic green sheets 30, a layered body (or a laminated body) is formed. After that, by degreasing and firing (or baking) the laminated body obtained, as explained above using FIGS. 1A to 1C, the waveguide slot antenna formed at the dielectric substrate 10 is completed.

Although contents of the present invention have been explained in detail on the basis of the above embodiments, the present invention is not limited to the above embodiments. The present invention can be modified within technical ideas of the present invention. For instance, the configuration of FIGS. 1A to 1C in the present embodiment is an example, and as long as working and effect of the present invention can be obtained, the present invention can be widely applied to a variety of waveguide slot antennas using other structures and other materials. Further, the other points in the contents of the present invention are also not limited by the above embodiments, and as long as working and effect of the present invention can be obtained, the other points can be modified as necessary without being limited by the above disclosure of the embodiments.

In the above embodiments, the basic shape of the slot 14*a* is explained as the rectangular shape having the long sides in the X-direction. However, the shape of the slot 14*a* could be a substantially rectangular shape having a curved or linear chamfered part(s) at a corner portion(s) of the rectangular shape having the long sides in the X-direction. In this case, in the same manner as the above embodiments, the range of the slot length L of the slot 14*a* means an area sandwiched by (between) the pair of long sides that extend along the X-direction, but these pair of long sides have no chamfered part.

EXPLANATION OF REFERENCE

10 . . . dielectric substrate, 11, 12 . . . conductive layer, 13 . . . via conductor, 14 . . . slot, 15 . . . power feeding part, 30 . . . ceramic green sheet, 31 . . . via hole, W1, W2 . . . side wall part, W3, W4 . . . short-circuit wall part

The invention claimed is:

1. A waveguide slot antenna comprising:

a waveguide formed by a dielectric substrate, a first conductive layer formed at a lower surface of the dielectric substrate, a second conductive layer formed at an upper surface of the dielectric substrate and provided with one or a plurality of slots, and a pair of side wall parts electrically connecting the first conductive layer and the second conductive layer and extending in a first direction that is a signal propagation direction in the waveguide; and a power feeding part formed so as to penetrate the dielectric substrate at least from the upper surface to the lower surface of the dielectric substrate and feeding an input signal to the waveguide, wherein the one or the plurality of slots includes a first slot having a rectangular shape having a predetermined slot length along the first direction, and wherein when viewed as a plan view from a second direction that is perpendicular to the second conductive layer, the power feeding part is arranged at a position where about ½ of the power feeding part overlaps the rectangular shape of the first slot, and the power feeding part does not deviate from a range of the slot length along the first direction.

2. The waveguide slot antenna as claimed in claim 1, wherein:

the power feeding part is formed by a power feeding terminal arranged on a same plane as the first conductive layer and not being in contact with the first conductive layer, an upper end portion arranged on a same plane as the second conductive layer and not being in contact with the second conductive layer, and a power feeding via conductor whose lower end is connected to the power feeding terminal and whose upper end is connected to the upper end portion.

3. The waveguide slot antenna as claimed in claim 1, further comprising:

a short-circuit wall part electrically connecting the first conductive layer and the second conductive layer, the short-circuit wall part being at least one of short-circuit surfaces of the waveguide which are orthogonal to the first direction, and wherein a distance between the short-circuit wall part and the power feeding part along the first direction corresponds to ¼ times of a wavelength of the input signal in the waveguide.

4. The waveguide slot antenna as claimed in claim 3, wherein:

the pair of side wall parts and the short-circuit wall part are formed by a plurality of via conductors connecting the first conductive layer and the second conductive layer.

5. The waveguide slot antenna as claimed in claim 1, wherein:

when viewed as the plan view from the second direction, the one or the plurality of slots is arranged at a position where the one or the plurality of slots is shifted from a center position between the pair of side wall parts in a third direction that is orthogonal to the first and second directions.

6. The waveguide slot antenna as claimed in claim 5, wherein:

the one or the plurality of slots includes only the first slot.

7. The waveguide slot antenna as claimed in claim 5, wherein:

the one or the plurality of slots further includes a slot other than the first slot, and adjacent slots of the one or the plurality of slots are arranged at symmetrical positions with respect to the center position in the third direction.

* * * * *